US005288688A

United States Patent [19]

Kawakami et al.

[11] Patent Number: 5,288,688

[45] Date of Patent: Feb. 22, 1994

[54] THERMAL RECORDING MATERIAL

[75] Inventors: Hiroshi Kawakami; Chiyoshi Nozaki; Ken Iwakura, all of Shizuoka, Japan

[73] Assignee: Fuji Photo Film Co., Ltd., Kanagawa, Japan

[21] Appl. No.: 36,390

[22] Filed: Mar. 24, 1993

[30] Foreign Application Priority Data

Mar. 24, 1992 [JP] Japan ..... 4-66212

[51] Int. Cl.[5] ..... B41M 5/30

[52] U.S. Cl. ..... 503/217; 503/221; 503/225

[58] Field of Search ..... 427/150-152; 503/217, 221, 209, 208, 225

[56] References Cited

U.S. PATENT DOCUMENTS 4,965,237 10/1990 Hiraishi et al. ..... 503/209
5,079,211 1/1992 Shimura et al. ..... 503/217

FOREIGN PATENT DOCUMENTS 60-184879 9/1985 Japan ..... 503/217
60-210491 10/1985 Japan ..... 503/217

OTHER PUBLICATIONS

English language abstract for Unexamined Japanese Patent Application No. JP-A-210491.
English language abstract for Unexamined Japanese Patent Application No. JP-A-60-184879.

*Primary Examiner*—B. Hamilton Hess
*Attorney, Agent, or Firm*—Sughrue, Mion, Zinn, Macpeak & Seas

[57] ABSTRACT

Disclosed is a thermal recording material having, on a support, a heat-sensitive coloring layer containing an electron-donating colorless dye, an isocyanate compound and an amino compound. The storage stability of the raw stock material as well as the color image stability of the material are excellent.

4 Claims, No Drawings

THERMAL RECORDING MATERIAL

FIELD OF THE INVENTION

The present invention relates to a thermal recording material and, more precisely, to one comprising, on a support, a coloring layer containing an electron-donating colorless dye and electron-accepting compound precursors. The material is characterized by improved coloring capacity, raw stock storability and color image stability.

BACKGROUND OF THE INVENTION

Recording materials containing an electron-donating colorless dye and an electron-accepting compound has heretofore been used as a pressure-sensitive paper, a thermal paper, a light-sensitive pressure-sensitive paper, an electric thermal recording paper, a thermal transfer paper and others. For instance, the details of such materials are described in British Patent 2,140,449, U.S. Pat. Nos. 4,480,052 and 4,436,920, JP-B-60-23992, JP-A-57-179836, JP-A-60-123556 and JP-A-60-123557. (The terms "JP-A" and "JP-B" as used herein mean an "unexamined Japanese patent application" and an "examined Japanese patent publication", respectively.) In particular, a thermal recording material is described in detail in JP-B-43-4160 and JP-B-45-14039. Thermal recording systems are used in used in various fields for facsimiles, printers and labels, and the need for them is increasing.

However, since a thermal recording material involves the drawbacks that it is often fogged with solvents and its colorant is often faded with oils, fats or chemicals, its commercial value is lowered, especially in the field of labels, vouchers, word processor papers and plotter papers. The present inventors have studied electron-donating colorless dyes and electron-accepting compounds, to develop good constituent raw materials for recording materials, as well as good recording materials themselves, with respect to oil solubility, water solubility, partition coefficient, pKa, polarity of substituents, and position of substituents of such dyes and compounds. It has been found, however, that materials which are hardly fogged with solvents are often faded with oils, fats and chemicals, while those which are hardly faded with oils, fats and chemicals are often fogged with solvents.

SUMMARY OF THE INVENTION

One object of the present invention is to provide a thermal recording material having a high sensitivity and improved raw stock storability and color image stability.

This and other objects have been attained by a thermal recording material comprising, on a support, a heat-sensitive coloring layer containing an electron-donating colorless dye, an isocyanate compound, and an amino compound. Specifically, the inventors have found that the isocyanate compound and the amino compound in the material react with each other to form an electron-donating compound and have attained the present invention on the basis of that finding. Precisely, the isocyanate compound and the amino compound in the material react with each other under heat to give an urea compound which acts as an electron-donating compound in the material.

DETAILED DESCRIPTION OF THE INVENTION

JP-A-60-184879 and JP-A-60-210491 disclose a thermal recording material containing a blocked phenol as an electron-accepting compound. However, the isocyanate compound in the material merely blocks the phenol compound therein and it is formed by pyrolysis and requires an extremely large amount of heat for dissociation.

The isocyanate compound in the material of the present invention is a colorless or pale color isocyanate compound which is solid at room temperature and is preferably an aromatic isocyanate compound having two or more —NCO groups.

Specific examples of the isocyanate compound in the material of the present invention include 2,6-dichlorophenyl isocyanate, p-chlorophenyl isocyanate, 1,3-phenylenediisocyanate, 1,4-phenylenediisocyanate, 1,3-dimethylbenzene-4,6-diisocyanate, 1,4-dimethylbenzene-2,5-diisocyanate, 1-methoxybenzene-2,4-diisocyanate, 1-methoxybenzene-2,5-diisocyanate, 1-ethoxybenzene-2,4-diisocyanate, 2,5-dimethoxybenzene-1,4-diisocyanate, 2,5-diethoxybenzene-1,4-diisocyanate, 2,5-dibutoxybenzene-1,4-diisocyanate, azobenzene-4,4'-diisocyanate, diphenylether 4,4'-diisocyanate, naphthalene-1,4-diisocyanate, naphthalene-1,5-diisocyanate, naphthalene-2,6-diisocyanate, naphthalene-2,7-diisocyanate, 3,3'-dimethyl-biphenyl-4,4'-diisocyanate, diphenylmethane-4,4'-diisocyanate, benzophenone-3,3'-diisocyanate, fluorene-2,7-diisocyanate, anthraquinone-2,6-diisocyanate, 9-ethylcarbazole-3,6-diisocyanate, pyrene-3,8-diisocyanate, naphthalene-1,3,7-triisocyanate, biphenyl-2,4,4-triisocyanate, 4,4',4''-triisocyanato-2,5-dimethoxytriphenylamine, p-dimethylaminophenyl isocyanate, and tris(4-phenylisocyanato)thiophosphate. These may be used singly or in combination of two or more. The content of the isocyanate compound in the material of the present invention is preferably from 50 to 800% by weight, more preferably from 100 to 500% by weight, to the electron-donating colorless dye therein.

The amino compound in the material of the present invention is a compound having one or more $NH_2$ groups.

Preferred amino compounds for use in the present invention are those of formula (I):

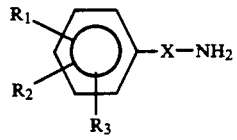

(I)

wherein

X represents a direct bond, —CO—, —$SO_2$—, —CONH— or —$SO_2$NH—;

$R_1$, $R_2$ and $R_3$ each represents a hydrogen atom, an alkyl group, an aryl group, an alkoxy group, an aryloxy group, a sulfonyloxy group, an oxycarbonyl group, a carbamoyl group, a sulfamoyl group, an oxysulfonyl group, an acyl group, a sulfonyl group, a halogen atom, a nitro group, a cyano group, a hydroxyl group, —$CONH_2$, —$SO_2NH_2$, —$CONHNH_2$, —$SO_2NHNH_2$ or a group represented by formula (II):

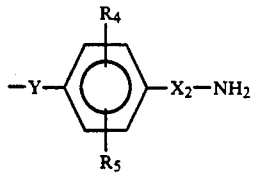

(II)

in which

Y represents a divalent group;

$R_4$ and $R_5$ each represents a hydrogen atom, an alkyl group, an aryl group, an alkoxy group, an acyl group, a sulfonyl group, a halogen atom, a nitro group or a cyano group;

$X_2$ represents a divalent bond, —CO—, —$SO_2$—, —CONH— or —$SO_2$NH—.

The $R_1$, $R_2$, $R_3$, $R_4$ and $R_5$ substituents in the preceding formulae may further be substituted with a substituent having 1 to 8 carbon atoms, and $R_1$ and $R_2$, and $R_4$ and $R_5$ in them may be bonded to each other to form a ring.

More preferably, the thermal recording material of the present invention contains an amino compound having two or more amino groups. Among such amino compounds having two or more amino groups, preferred are those of formula (III):

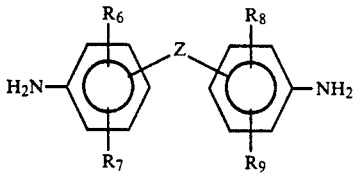

(III)

wherein

Z represents a divalent group; and $R_6$, $R_7$, $R_8$ and $R_9$ each represents a hydrogen atom, an alkyl group, an aryl group, an alkoxy group, an acyl group, a sulfonyl group, a halogen atom, a nitro group or a cyano group.

Examples of Z include the following linking groups, in addition to a single bond:

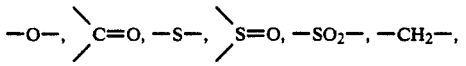

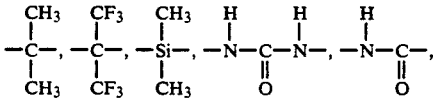

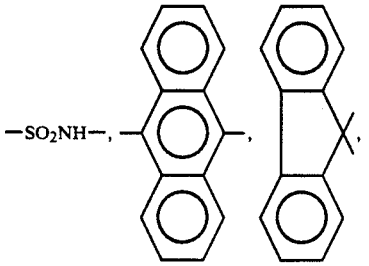

-continued

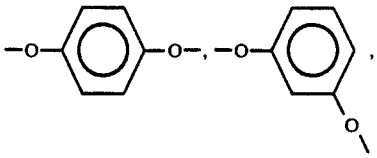

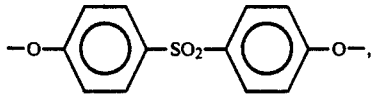

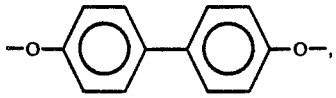

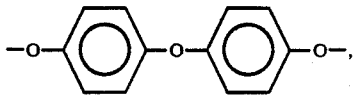

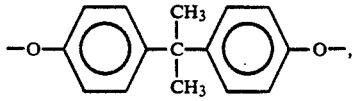

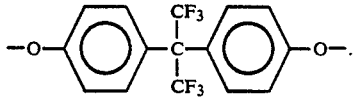

Specific examples of the amino compound in the present invention include 4-biphenyloxyaniline, 3-diphenylmethyloxyaniline, 4-phenoxyacetylaniline, 4-phenylacetylaniline, 4-myristoylaniline, 3-phenylsulfonylaniline, 3-biphenylsulfonylaniline, 3-dodecylsulfonylaniline, 3-biphenylsulfonyloxyaniline, 3-β-naphthalenesulfonyloxyaniline, 4-benzyloxycarbonylaniline, 3-dodecyloxycarbonylaniline, 4-N-phenylcarbamoylaniline, 4-N-dodecylcarbamoylaniline, 4-N-benzylcarbamoylaniline, 4-N-phenylsulfamoylaniline, 4-N-dodecylsulfamoylaniline, 4-N-benzylsulfamoylaniline, 4-biphenyloxysulfonylaniline, 3-β-naphthyloxysulfonylaniline, 4-benzyloxybenzamide, 4-dodecyloxybenzamide, 4-benzyloxycarbonylbenzamide, 3-benzyloxycarbonylbenzamide, 2-benzyloxybenzamide, 3,5-dicumylsalicylamide, 3,5-di-t-butylsalicylamide, 4-benzyloxybenzenesulfonamide, 4-benzyloxycarbonylbenzenesulfonamide, 4-benzyloxybenzohydrazide, β-naphthohydrazide, 1-p-toluenesulfonylhydrazine, 1-(4-benzyloxybenzenesulfonyl) hydrazine, 3,3'-dimethyl-4,4'-diaminodiphenyl, 2,2',5,5'-tetrachloro-4,4'-diaminodiphenyl, 4,4'-methylenebis(2-chloroaniline), 4,4'-diaminodiphenylether, 4,4'-diaminodiphenylsulfone, 2,2-bis[4-(4-aminophenoxy)-phenyl]propane, bis[4-(4-aminophenoxy)phenyl]sulfone, bis[4[(3-aminophenoxy)phenyl]sulfone, 4,4'-bis(4-amino-phenoxy)-biphenyl, bis[4-(4-aminophenoxy)phenyl]ether, 2,2-bis[4-( 4-aminophenoxy)phenyl]hexafluoropropane, 1,4-bis(4-aminophenoxy)benzene, 4,4'-diaminodiphenylsulfide, 3,3'-diaminodiphenylsulfone, 4,4'-diaminobenzanilide, 9,10-bis(4-aminophenyl)anthracene, 9,9-bis(4-aminophenyl)fluorenone, o-toluidinesulfone, 2,2-bis[4-(4-aminophenylmethyl)phenyl]-hexafluoropropane, 2,2-bis[4-(4-aminobenzoyl)phenyl]hexafluoropropane, 2,2-bis[4-(N-4-aminophenylcarbamoyl)phenyl]hexafluoropropane, 2,2-bis[4-(4-aminopheoxy)phenyl]propane, 2,2-bis[4-(4-aminophenoxymehtyl)phenyl]propane, 2,2-bis[4-(4-aminobenzoyl)phenyl]propane, 2,2-bis[4-(N-4-aminophenylcarbamoyl)phenyl]propane, and 2,2-bis[4-β-(4-aminophenoxy)ethoxyphenyl]propane.

These may be used singly or in combination of two or more. The amount of the amino compound in the material of the present invention is preferably from 5 to 1000% by weight, more preferably from 10 to 500% by weight, to the isocyanate compound. The isocyanate compound and the amino compound are milled in a sand mill or the like to fine grains, which preferably have a grain size of 3 μm or less, more preferably 2 μm or less, so as to attain a sufficiently high coloring sensitivity. The isocyanate compound may be milled along with the amino compound of the invention and/or an alcoholic compound.

The isocyanate compound and the amino compound of the present invention may be combined with other known electron-accepting compounds such as phenol derivatives, phenol resins, novolak resins, metal-treated novolak resins, metal complexes, salicylic acid derivatives, metal salts of aromatic carboxylic acids, acid clay and bentonite. Examples of such compounds are described in, for example, JP-B-40-9309, JP-B-45-14039, JP-A-52-140483, JP-A-48-51510, JP-A-57-210886, JP-A-58-87089, JP-A-59-11286, JP-A-60-176795, JP-A-61-95988. They include 4-tert-butylphenol, 4-phenylphenol, 2,2'-dihydroxybiphenyl, 2,2-bis(4-hydroxyphenyl)propane(bisphenol A), 4,4'-secbutylidenediphenol, 4,4'-cyclohexylidenediphenol, bis(3-aryl-4-hydroxyphenyl)sulfone, 4-hydroxyphenyl-3',4'-dimethylphenylsulfone, 4-(4-isopropoxyphenylsulfonyl)phenol, 4,4'-dihydroxydiphenylsulfide, 1,4-bis-(4'-hydroxycumyl)benzene, 1,3-bis-(4'-hydroxycumyl)benzene, 4,4'-thiobis(6-tert-butyl-3-methylphenol), 1,1,3-tris(2-methyl-4-hydroxy-5-tert-butylphenyl)butane, 4,4'-butylidenebis(3-methyl-6-tert-butylphenol), 4,4'-dihydroxydiphenylsulfone, benzyl 4-hydroxybenzoate, 3,5-di-tert-butylsalicylic acid, 3-phenyl-5-(α,α-dimethylbenzyl)salicylic acid, 3-cumyl-5-t-octylsalicylic acid, 3,5-di-t-butylsalicylic acid, 3-phenyl-5-t-octylsalicylic acid, 3-methyl-5-α-methylbenzylsalicylic acid, 3-methyl-5-cumylsalicylic acid, 3,5-di-t octylsalicylic acid, 3,5-bis(α-methylbenzyl)salicylic acid, 3-cumyl-5-phenylsalicylic acid, 5-n-octadecylsalicylic acid, 4-pentadecylsalicylic acid, 3,5-bis(α,α-dimethylbenzyl)-salicylic acid, 3,5-bis-t-octylsalicylic acid, 4-β-dodecyloxyethoxysalicylic acid, 4-methoxy-6-dodecyloxysalicylic acid, 4-β-penoxyethoxysalicylic acid, 4-β-p-ethylphenoxyethoxysalicylic acid, 4-β-p-methoxyphenoxyethoxysalicylic acid and their metal salts. The proportion of the preceding electron-accepting compounds to be combined with the compounds of the present invention is preferably from 0 to 200% by weight to the isocyanate compound. Two or more of the preceding electron-accepting compounds may be used in combination.

Examples of the electron-donating colorless dye in the material of the present invention include triphenylmethanephthalide compounds, fluoran compounds, phenothiazine compounds, indolylphthalide compounds, leucoauramine compounds, rhodamine-lactam compounds, triphenylmethane compounds, triazene compounds, spiropyrane compounds, fluorene compounds and others. Examples of the phthalides are described in U.S. Pat. No. 23,024, U.S. Pat. Nos. 3,491,111, 3,491,112, 3,491,116, 3,509,174; fluorans, in U.S. Pat. Nos. 3,624,107, 3,627,787, 3,641,011, 3,462,828, 3,681,390, 3,920,510, 3,959,571; spiropyranes, in U.S. Patent 3,971,808; pyridine and pyrazine compounds, in U.S. Patent 3,775,424, 3,853,869 and 4,246,318; and fluorene compounds, in JP-A-63-94878.

Of them, especially effective are a black-coloring 2-arylamino-3-H, a halogen atom or an alkyl-6-substituted aminofluorans. Specific examples include 2-anilino-3-methyl-6-diethylaminofluorane, 2-anilino-3-methyl-6-N-cyclohexyl-N-methylaminofluorane, 2-p-chloroanilino-3-methyl-6-dibutylaminofluorane, 2-anilino-3-chloro-6-diethylaminofluorane, 2-anilino-3-methyl-6-N-ethyl-N-isoamylaminofluorane, 2-anilino-3-methyl-6-N-ethyl-N-dodecylaminofluorane, 2-o-chloroanilino-6-dibutylaminofluorane, 2-anilino-3-pentadecyl-6-diethylaminofluorane, 2-anilino-3-ethyl-6-dibutylaminofluorane, 2-o-toluidino-3-methyl-6-diisopropylaminofluorane, 2-anilino-3-methyl-6-N-isobutyl-N-ethylaminofluorane, 2-anilino-3-methyl-6-N-ethyl-N-tetrahydrofurfurylaminfluorane, 2-anilino-3-chloro-6-N-ethyl-N-isoamylaminofluorane, 2-anilino-3-methyl-6-N-methyl-N-γ-ethoxypropylaminofluorane, 2-anilino-3-methyl-6-N-ethyl-N-γ-ethoxypropylaminofluorane, 2-anilino-3-methyl-6-N-ethyl-N-γ-propoxypropylaminofluorane, and 2-anilino-3-methyl-6-N-methyl-N-propylaminofluorane.

The thermal recording material according to the present invention may contain a sensitizing agent.

Examples of the sensitizing agent for use in the present invention include compounds disclosed in JP-A-58-57989, JP-A-58-87094 and JP-A-63-39375. Specific examples include aromatic ethers (especially, benzyl ethers, di(substituted phenoxy)alkanes), aromatic esters, aliphatic amides and ureas, and aromatic amides and ureas.

A general description of the preparation and components of thermal recording materials is found in U.S. Pat. Nos. 4,480,052 and 4,436,920.

Typical examples of preparation of the heat-sensitive coloring layer constituting the material of the present invention are mentioned below. The electron-donating colorless dye, isocyanate compound, amino compound and sensitizing agent are milled along with an aqueous solution of a water-soluble high polymer, such as polyvinyl alcohol, for example, with a ball mill, sand mill or the like to form a dispersion of grains of several microns or less. The sensitizing agent may be added to any or all of the electron-donating colorless dye, isocyanate compound and amino compound for simultaneous dispersion along with them. The resulting dispersions are then mixed and, if desired, a pigment, a surfactant, a binder, a metal soap, a wax, an antioxidant, an ultra-violet absorbent and other additives may be added thereto to obtain a heat-sensitive coating liquid.

The thus obtained heat-sensitive coating liquid is then coated on woodfree paper, synthetic paper, plastic film or the like having a subbing layer, dried, and thereafter calendered so that the surface of the coated layer is smoothed. Thus, the intended thermal recording material is obtained.

The support to be coated with the coating liquid is desired to have a smoothness of 500 seconds or more, especially 800 seconds or more, as defined by JIS-8119, in view of dot reproducibility. The support having a smoothness of 500 seconds or more may be, (1) a synthetic paper or plastic film having a high smoothness is used, (2) a subbing layer consisting essentially of a pigment is formed on the support, or (3) the support is calendered with a super-calender so as to elevate smoothness.

As the binder for use in the present invention, preferred are compounds capable of being dissolved in water of 25° C. in an amount of 5% by weight or more. Examples include polyvinyl alcohols (including modified polyvinyl alcohols such as carboxy modified, itaconic acid-modified, maleic acid-modified or silica-modified polyvinyl alcohols), methyl cellulose, carboxymethyl cellulose, starches (including modified starches), gelatin, gum arabic, casein, hydrolysates of styrene-maleic acid copolymers, polyacrylamide, and saponified products of vinyl acetate-polyacrylic acid copolymers. The binder is used not only for dispersion but also for improving the strength of the coated film. For the latter purpose, latex binders such as styrene-butadiene copolymers, vinyl acetate copolymers, acrylonitrile-butadiene copolymers, methyl acrylate-butadiene copolymers and polyvinylidene chloride, may be used along with the binder. If desired, a binder crosslinking agent may be added to the binder according to the kind of the binder.

The pigments for use in the present invention include calcium carbonate, barium sulfate, lithopone, agalmatolite, kaolin, and amorphous silica. The metal soaps for the same purpose include metal salts of higher fatty acids, such as zinc stearate, calcium stearate and aluminium stearate. If desired, a surfactant, an antistatic agent, an ultraviolet absorbent, a defoaming agent, an electroconductive agent, a fluorescent dye and a coloring dye may optionally be added to the layer. The coated thermal recording material is calendered and is put to practical use. If desired, a protective layer may be formed on the heat-sensitive coloring layer. The protective layer may be any known type. If further desired, a backing layer may be provided on the surface of the thermal recording material opposite to the surface thereof coated with the heat-sensitive coloring layer. The backing layer may be any known type.

The present invention will be explained in more detail by way of the following examples, which, however, are not intended to restrict the scope of the present invention.

EXAMPLE 1

Twenty g of 2-anilino-3-methyl-6-N-methyl-N-n-propylaminofluoran as an electron-donating colorless dye, 20 g of 4,4",4"-triisocyanato-2,5-dimethoxytriphenylamine as an isocyanate compound, 20 g of 3,3'-diaminodiphenylsulfone as an amino compound, and 20 g of β-naphthylbenzyl ether as a sensitizing agent were separately milled each along with 100 g of an aqueous solution of 5% polyvinyl alcohol (Kuraray PVA-105) in a ball mill overnight to obtain respective dispersions each having a mean grain size of 1.5 μm or less. Eighty g of calcium carbonate was homogenized along with 160 g of a 0.5% solution of sodium hexametaphosphate in a homogenizer to obtain a pigment dispersion. These dispersions prepared above were admixed in a proportion of 5 g of the electron-donating colorless dye dispersion, 5 g of the isocyanate compound dispersion, 5 g of the amino compound dispersion, 10 g of the β-naphthylbenzylether dispersion and 5 g of the calcium carbonate dispersion; and 3 g of a 21% zinc stearate emulsion was added thereto to obtain a coating liquid for a heat-sensitive coloring layer. The coating liquid was coated on a woodfree paper having a basic weight of 50 g/m$^2$, in a dry weight of 5 g/m$^2$, and dried at 50° C. for one minute to obtain a thermal recording paper.

EXAMPLE 2

A thermal recording paper was prepared in the same manner as in Example 1, except that bis[4-(4-aminophenoxy)phenyl]sulfone was used in place of 3,3'-diaminodiphenylsulfone in preparing the heat-sensitive coating liquid.

EXAMPLE 3

A thermal recording paper was prepared in the same manner as in Example 1, except that bis[4 (3-aminophenoxy)phenyl]sulfone was used in place of 3,3'-diaminodiphenylsulfone in preparing the heat-sensitive coating liquid.

EXAMPLE 4

A thermal recording paper was prepared in the same manner as in Example 1, except that 4,4'-diaminobenzanilide was used in place of 3,3'-diaminodiphenylsulfone in preparing the heat-sensitive coating liquid.

EXAMPLE 5

A thermal recording paper was prepared in the same manner as in Example 1, except that bis[4-(4-aminophenoxy)phenyl]ether was used in place of 3,3'-diaminodiphenylsulfone in preparing the heat-sensitive coating liquid.

EXAMPLE 6

A thermal recording paper was prepared in the same manner as in Example 1, except that 2,2-bis[4-(4-aminophenoxy)phenyl]hexafluoropropane was used in place of 3,3'-diaminodiphenylsulfone in preparing the heat-sensitive coating liquid.

EXAMPLE 7

A thermal recording paper was prepared in the same manner as in Example 1, except that 1-p-toluenesulfonylhydrazine was used in place of 3,3'-diaminodiphenylsulfone in preparing the heat-sensitive coating liquid.

EXAMPLE 8

A thermal recording paper was prepared in the same manner as in Example 1, except that m toluenesulfonamide was used in place of 3,3'-diaminodiphenylsulfone in preparing the heat-sensitive coating liquid.

COMPARATIVE EXAMPLE 1

A thermal recording paper was prepared in the same manner as in Example 1, except that 3,3'-diaminodiphenylsulfone was not added in preparing the heat-sensitive coating liquid.

COMPARATIVE EXAMPLES 2 TO 5

Thermal recording papers were prepared in the same manner as in Example 1, except that 10 g of a dispersion of bisphenol A, 4-(4-isopropoxyphenylsulfonyl)phenol, 4,4'-butylidene-bis(3-methyl-6-tert-butylphenol) or 1,4-bis-(4'-hydroxycumyl)benzene was used in place of 5 g of the 4,4',4"-triisocyanato-2,5-dimethoxytriphenylamine dispersion and 5 g of the 3,3'-diaminodiphenylsulfone dispersion in preparing the heat-sensitive coating liquid.

COMPARATIVE EXAMPLE 6

A thermal recording paper was prepared in the same manner as in Example 1, except that 10 g of a dispersion prepared by milling 20 g of a compound previously prepared by reacting the same molar amounts of 4,4',4''-triisocyanato-2,5-dimethoxytriphenylamine and 3,3'-diaminodiphenylsulfone in a toluene solution at 50° C. for 2 hours, along with 100 g of an aqueous 5% solution of polyvinyl alcohol (Kuraray PVA-105) in a ball mill overnight was used in place of 5 g of the 4,4',4''-triisocyanato-2,5-dimethoxytriphenylamine dispersion and 5 g of the 3,3'-diaminodiphenylsulfone dispersion in preparing the heat-sensitive coating liquid.

The thermal recording papers obtained above were surface-treated by calendering to have a Beck smoothness of 300±50 seconds. These were evaluated by the methods mentioned below.

(1) For evaluating the coloring capacity, each paper sample was printed with a printing energy of 30 mJ/mm$^2$, using a printing tester made by Kyocera Corporation, and the color density of the printed sample was measured with a Mackbeth densitometer. The higher the value measured, the higher the sensitivity of the paper sample tested.

(2) For evaluating the chemical resistance, each paper sample was printed with a printing energy of 30 mJ/mm$^2$, using a printing tester made by Kyocera Corporation, and the colored area of the sample was attached to a filter paper which had previously been impregnated with ethanol or a plasticizer (dioctyl phthalate). After 48 hours, the degree of fog and discoloration (or fading or decoloration) of the colored area were determined. The results obtained are shown in Table 1 below.

TABLE 1

| | Color Density | Ethanol | | Plasticizer | |
|---|---|---|---|---|---|
| | | Fog | Discoloration | Fog | Discoloration |
| Ex. 1 | 1.24 | ○ | ◎ | ○ | ◎ |
| Ex. 2 | 1.12 | ◎ | ◎ | ○ | ◎ |
| Ex. 3 | 1.17 | ○ | ◎ | ○ | ◎ |
| Ex. 4 | 1.09 | ○ | ◎ | ○ | ◎ |
| Ex. 5 | 1.20 | ◎ | ◎ | ◎ | ◎ |
| Ex. 6 | 1.11 | ◎ | ◎ | ◎ | ○ |
| Ex. 7 | 0.96 | ◎ | ○ | ○ | ○ |
| Ex. 8 | 1.00 | ◎ | ○ | ○ | ○ |
| Comp. Ex. 1 | 0.71 | ◎ | ○ | ◎ | ○ |
| Comp. Ex. 2 | 1.30 | X | X | X | X |
| Comp. Ex. 3 | 1.29 | X | Δ | X | Δ |
| Comp. Ex. 4 | 1.13 | ○ | ○ | ○ | X |
| Comp. Ex. 5 | 1.25 | ○ | Δ | ○ | X |
| Comp. Ex. 6 | 0.25 | ○ | X | ○ | X |

◎: Excellent (no change)
○: Very Good (slight change)
Δ: Good (practicable, image could be read)
X: Bad (image could hardly be read)

As is shown by the results in Table 1 above, all the recording material samples of the present invention are free from fogging coloration or discoloration in the colored area due to the chemicals applied thereto and therefore have excellent chemical resistance.

While the invention has been described in detail and with reference to specific embodiments thereof, it will be apparent to one skilled in the art that various changes and modifications can be made therein without departing from the spirit and scope thereof.

What is claimed is:

1. A thermal recording material comprising, on a support, a heat-sensitive coloring layer containing an electron-donating colorless dye, an isocyanate compound and an amino compound, wherein the amino compound is one represented by formula (I):

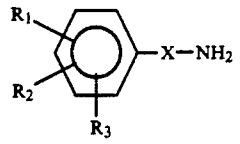

(I)

wherein X represents a direct bond, —CO—, —$SO_2$—, —CONH— or —$SO_2$NH—; $R_1$, $R_2$, and $R_3$ each represents a hydrogen atom, an alkyl group, an aryl group, an alkoxy group, an aryloxy group, a sulfonyloxy group, an oxycarbonyl group, a carbamoyl group, a sulfamoyl group, an oxysulfonyl group, an acyl group, a sulfonyl group, a halogen atom, a nitro group, a cyano group, a hydroxyl group, —$CONH_2$, —$SO_2NH_2$, —$CONHNH_2$, —$SO_2NHNH_2$ or a group represented by formula (II):

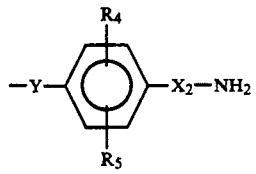

(II)

wherein y represents a divalent group;

$R_4$ and $R_5$ each represents a hydrogen atom, an alkyl group, an aryl group, an alkoxy group, an acyl group, a sulfonyl group, a halogen atom, a nitro group or a cyano group;

$X_2$ represents a direct bond, —CO—, —$SO_2$—, —CONH— or —$SO_2$NH—; and the $R_1$, $R_2$, $R_3$, $R_4$ and $R_5$ substituents may optionally be substituted, and $R_1$ and $R_2$, and $R_4$ and $R_5$ each may be bonded to each other to form a ring;

wherein the electron-donating colorless dye is a black-coloring fluoran compound substituted by an arylamino group at the 2-position, a hydrogen atom, a halogen atom or an alkyl group at the 3-position and an amino group at the 6-position, said amino group being further substituted by an alkyl group, a cycloalkyl group, an alkoxyalkyl group or a tetrahydrofurfuryl group.

2. The thermal recording material as claimed in claim 1, in which the isocyanate compound is an aromatic isocyanate compound having 2 or more —NCO groups.

3. The thermal recording material as claimed in claim 1, in which the amino compound has 2 or more amino groups.

4. The thermal recording material as claimed in claim 3, in which the amino compound is one represented by formula (III):

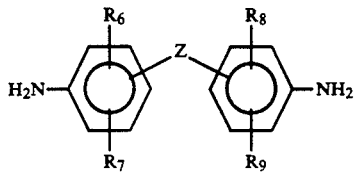

(III)

wherein

Z represents a divalent group; and $R_6$, $R_7$, $R_8$ and $R_9$ each represents a hydrogen atom, an alkyl group, an aryl group, an alkoxy group, an acyl group, a sulfonyl group, a halogen atom, a nitro group or a cyano group.

* * * * *